US007570142B2

(12) United States Patent
Makita et al.

(10) Patent No.: US 7,570,142 B2
(45) Date of Patent: Aug. 4, 2009

(54) PERMANENT MAGNET FOR PARTICLE BEAM ACCELERATOR AND MAGNETIC FIELD GENERATOR

(75) Inventors: Ken Makita, Shimamoto-cho (JP); Eiji Sugiyama, Nishinomiya (JP); Masaaki Aoiki, Takatsuki (JP); Kaichi Murakami, Itami (JP); Tadamichi Kawakubo, Tsukuba (JP); Eiji Nakamura, Tsukuba (JP)

(73) Assignee: Hitachi Metals, Ltd., Tokyo (JP)

( * ) Notice: Subject to any disclaimer, the term of this patent is extended or adjusted under 35 U.S.C. 154(b) by 371 days.

(21) Appl. No.: 10/524,314

(22) PCT Filed: Feb. 20, 2004

(86) PCT No.: PCT/JP2004/002038

§ 371 (c)(1),
(2), (4) Date: Feb. 9, 2005

(87) PCT Pub. No.: WO2004/077457

PCT Pub. Date: Sep. 10, 2004

(65) Prior Publication Data

US 2005/0258784 A1 Nov. 24, 2005

(30) Foreign Application Priority Data

Feb. 27, 2003 (JP) ..... 2003-050541

(51) Int. Cl.
*H01F 7/02* (2006.01)
*H05H 13/00* (2006.01)

(52) U.S. Cl. ..... 335/306; 315/501

(58) Field of Classification Search ..... 335/210, 335/302, 306; 315/5.35, 501–505
See application file for complete search history.

(56) References Cited

U.S. PATENT DOCUMENTS

| | | | | |
|---|---|---|---|---|
| 2,890,348 | A * | 6/1959 | Ohkawa | 250/285 |
| H000591 | H * | 3/1989 | Leupold | 29/607 |
| 4,995,905 | A | 2/1991 | Sagawa | |
| 5,292,380 | A | 3/1994 | Tanigawa et al. | |
| 5,347,254 | A * | 9/1994 | Leupold | 335/306 |
| 5,635,889 | A * | 6/1997 | Stelter | 335/306 |

FOREIGN PATENT DOCUMENTS

JP 02-101146 4/1990

(Continued)

OTHER PUBLICATIONS

Lee, et al., Permanent magnet array for magnetic refrigerator, May 15, 2002, J. App. Phy., vol. 91, No. 10, pp. 8894-8896.*

(Continued)

*Primary Examiner*—Ramon M Barrera
(74) *Attorney, Agent, or Firm*—Keating & Bennett, LLP

(57) ABSTRACT

A permanent magnet for a particle accelerator and a magnetic field generator, in which Nd—Fe—B based magnets are used but are not demagnetized so easily even when exposed to a radiation, are provided. A permanent magnet for a particle accelerator is used in an environment in which the magnet is exposed to a radiation at an absorbed dose of at least 3,000 Gy. The magnet includes R (which is at least one of the rare-earth elements), B, TM (which is at least one transition element and includes Fe) and inevitably contained impurity elements. The magnet is a sintered magnet that has been magnetized to a permeance coefficient of 0.5 or more and that has a coercivity $H_{cJ}$ of 1.6 MA/m or more.

7 Claims, 3 Drawing Sheets

FOREIGN PATENT DOCUMENTS

| | | |
|---|---|---|
| JP | 02-114499 | 4/1990 |
| JP | 04-334899 | 11/1992 |
| JP | 06-260316 | 9/1994 |
| JP | 08-255726 | 10/1996 |
| JP | 10-270197 | 10/1998 |
| JP | 2001-028300 | 1/2001 |
| JP | 2002-299110 | 10/2002 |
| JP | 2003-305021 | 10/2003 |

OTHER PUBLICATIONS www.dextermag.com/Magnetic-Theory-Design.aspx.*

OSHA Material Safety Data Sheet for Neodymium Series Rare Earth Magnet, Shin-Etsu Chemical Co.*

Okuda et al.; "Effects of Electron-Beam and γ-Ray Irradiation On The Magnetic Flux of Nd-Fe-B and Sm-Co Permanent Magnets"; Nuclear Instruments and Methods in Physics Research B; vol. 94 (1994); pp. 227-230.

Ito et al.; "Magnetic Flux Loss In Rare-Earth Magnets Irradiated With 200 MeV Protons"; Nuclear Instruments and Methods in Physics Research B; vol. 183 (2001); pp. 323-328.

Official Communication issued in the corresponding International Application No. PCT/JP2004/002038, mailed Mar. 2, 2006.

* cited by examiner

PERMANENT MAGNET FOR PARTICLE BEAM ACCELERATOR AND MAGNETIC FIELD GENERATOR

BACKGROUND OF THE INVENTION

1. Field of the Invention

The present invention relates to a permanent magnet for use in an environment in which the magnet is exposed to a radiation at an absorbed dose of 3,000 Gy or more. More particularly, the present invention relates to a permanent magnet for a particle accelerator, which may be used in either a synchrotron for the purpose of physical properties research or a cyclotron in the field of radiotherapy. The present invention also relates to a magnetic field generator including a plurality of such magnets.

2. Description of the Related Art

Examples of particle accelerators includes a synchrotron, which is used to generate a high-energy particle beam for the purpose of physical properties research, and a small-sized cyclotron, which produces a radioisotope for use in the diagnosis of cancer. Recently, those accelerators have just been introduced into a sort of radiotherapy for directly irradiating the diseased part of a cancer sufferer with a proton ray, not just for those diagnosis purposes.

A particle accelerator includes a mechanism for receiving an incoming particle beam, a mechanism for accelerating charged particles with the application of a radio frequency electric field thereto, and a mechanism for applying a magnetic field to bend the particle beam in any desired direction.

In a synchrotron, for example, a bending magnetic field for making the particle beam travel along an annular orbit that is called a "main ring" or a "storage ring", a focusing magnetic field for focusing the particle beam in the orbit, and a bending magnetic field for making the particle beam incident on, or outgoing from, the main ring are used. In a cyclotron on the other hand, a uniform static magnetic field is used to accelerate the particle beam spirally.

In the prior art, the magnetic fields described above are generated by electromagnets in both the synchrotron and cyclotron.

In a particle accelerator, some parts thereof need to be adjusted by making the magnetic field strength variable like a focusing magnetic field according to the operating principle but other parts thereof need a constant static magnetic field during the operation. At the beam outlet port of the synchrotron, the orbit of the particle beam is slightly changed by applying a pulsed magnetic field from an electromagnet called a "kicker magnet" to the particle beam traveling along the main or storage ring. That particle beam is further bent significantly by an electromagnet called a "septum magnet". Such a septum magnet needs to generate a strong and uniform static magnetic field and is provided near the main ring of the particle accelerator. Thus, the magnetic field leaking from the space in which the septum magnet generates the strong magnetic field (i.e., magnetic field generating space) to the external space needs to be minimized (e.g., to 5 mT or less).

As to the cyclotron, a uniform static magnetic field needs to be generated as described above. However, if protons are used as particles to accelerate, then a strong static magnetic field of 1.0 T or more needs to be generated to bend the protons because protons have greater mass than electrons.

Magnets for use in those particle accelerators are disclosed in Japanese Patent Application Laid-Open Publications Nos. 64-72502, 8-255726, 2001-28300 and 2003-305021, for example.

As described above, an electromagnet for use in a particle accelerator needs to generate a strong magnetic field. Thus, during the operation, a large amount of current needs to be supplied to the coil of the electromagnet.

However, when a large amount of current is supplied to the coil, a lot of Joule heat is generated by the coil. Accordingly, to remove this heat quickly, a cooling mechanism needs to be provided around the coil.

Furthermore, when an electromagnet is used, the strong magnetic field that is generated intermittently by the electromagnet easily does damage on respective members that form the electromagnet, which is also a problem. In addition, a huge quantity of yoke material for use to make the electromagnet is mainly composed of iron, and therefore, is easily radioactivated when exposed to the radiation generated from the beam line. As used herein, the "to radioactivate" refers to a phenomenon that a portion of a substance exposed to an accelerated particle beam is transformed into a radionuclide and comes to have radioactivity itself. If the yoke material is radioactivated, then it becomes difficult for workers to access the electromagnets for maintenance purposes.

To avoid these various problems to arise when electromagnets are used in a particle accelerator, the electromagnets may be replaced with permanent magnets. For example, in a storage ring for a particle accelerator developed by Fermi Laboratory, United States, hard ferrite magnets are adopted. However, hard ferrite cannot generate a strong bending magnetic field (e.g., of about 2 T) if its size remains small. Thus, it would be impossible to use small-sized particle accelerators in general hospitals extensively.

A 2-17 SmCo sintered magnet is a high-performance magnet, which is not demagnetized so much even when exposed to a radiation and which has a maximum energy product exceeding 240 kJ/m$^3$. Thus, to generate a strong magnetic field for a particle accelerator, the 2-17 SmCo sintered magnet could be used. However, Co, which is a main ingredient and essential element of this magnet, is easily radioactivated. Thus, considering maintenance, it would also be difficult to adopt those magnets in the accelerator.

Meanwhile, an Nd—Fe—B based sintered magnet can exhibit as high performance as represented by its maximum energy product exceeding 320 kJ/m$^3$, and therefore, can contribute to reducing the size of the accelerator effectively. In addition, the Nd—Fe—B based sintered magnet is less likely to be radioactivated than the 2-17 SmCo sintered magnet. Nevertheless, the Nd—Fe—B based magnet is easily demagnetized when exposed to a radiation.

Hereinafter, it will be described exactly how an Nd—Fe—B based sintered magnet is demagnetized due to exposure to a radiation. FIG. 1 is a schematic representation showing a portion of an Nd—Fe—B based sintered magnet on a larger scale. In FIG. 1, the open circles ○ represent some constituent atoms of an $Nd_2Fe_{14}B$ type crystal, while the smaller solid circle represents a radiation with energy $E_0$ (a high-energy particle). This particle is supposed to fly along the arrow to collide against an atom located at the center of a region R. It should be noted that the radiation may be either a corpuscular radiation such a proton radiation, a neutron radiation, an alpha radiation, a beta radiation or a heavy ion corpuscular radiation or an electromagnetic wave such as a gamma ray or an X-ray.

As shown in FIG. 1, when the radiation collides with the nucleus of an atom in the Nd—Fe—B based sintered magnet, that atom may sometimes be shot away due to the impact of that collision but remains there in most cases. In the latter case, the incoming energy $E_0$ is absorbed as heat into the magnet, thereby augmenting the lattice vibration around that atom where the collision has happened. As a result, the temperature rises locally around the region R. Supposing the temperature before the radiation energy $E_0$ is absorbed into the region R is represented by $T_L$ and the temperature after the energy has been absorbed there by $T_H$, the magnitude of the temperature increase is given by $\Delta T=T_H-T_L$, which is proportional to the energy $E_0$. If the temperature $T_H$ after the magnet has been exposed to the radiation exceeds the Curie temperature $T_C$ thereof, then the magnetization of the region R inverts during the cooling process irrespective of the coercivity $H_{cJ}$ of the magnet or the magnitude of the permeance coefficient $P_c$ of the region R. The mechanism by which coercivity is produced in an Nd—Fe—B based sintered magnet is called a "nucleation type". Accordingly, once magnetization has inverted in the region R, the overall crystal grain, including that region R, will eventually cause magnetization inversion. As the exposure dose of the radiation increases, such magnetization inversion is propagated to more and more regions (i.e., crystal grains) of the sintered magnet. Consequently, the overall sintered magnet is soon demagnetized significantly.

Once demagnetized in this manner, the magnet can no longer generate a strong magnetic field constantly. That is why no conventional magnetic field generator for a particle accelerator has ever used Nd—Fe—B based sintered magnets successfully enough to put it as a commercially viable product on the market.

In order to overcome the problems described above, a primary object of the present invention is to provide a permanent magnet for a particle accelerator and a magnetic field generator, in which Nd—Fe—B based magnets are used but are not demagnetized so easily even when exposed to a radiation.

SUMMARY OF THE INVENTION

A permanent magnet for a particle accelerator according to the present invention is used in an environment in which the magnet is exposed to a radiation at an absorbed dose of at least 3,000 Gy. The magnet includes R (which is at least one of the rare-earth elements), B (boron), TM (which is at least one transition element and includes Fe) and inevitably contained impurity elements. The magnet is a sintered magnet that has been magnetized to a permeance coefficient of 0.5 or more and that has a coercivity $H_{cJ}$ of 1.6 MA/m or more.

In one preferred embodiment, the sintered magnet has a composition including 25.0 mass % to 40.0 mass % of R, 0.8 mass % to 1.2 mass % of B, inevitably contained impurity elements, and TM as the balance.

In another preferred embodiment, R includes Nd and/or Pr as its essential element(s).

In another preferred embodiment, R further includes Dy and/or Tb.

In another preferred embodiment, TM includes Co, which accounts for at most 1.0 mass % of the overall magnet.

A magnetic field generator according to the present invention is used in an environment in which the magnetic field generator is exposed to a radiation at an absorbed dose of at least 3,000 Gy. The magnetic field generator includes a plurality of permanent magnets that are arranged substantially in a ring so as to define a magnetic field generating space. Each said permanent magnet includes R (which is at least one of the rare-earth elements), B (boron), TM (which is at least one transition element and includes Fe) and inevitably contained impurity elements. The magnet is a sintered magnet that has been magnetized to a permeance coefficient of 0.5 or more and that has a coercivity $H_{cJ}$ of 1.6 MA/m or more.

In one preferred embodiment, the sintered magnet has a composition including 25.0 mass % to 40.0 mass % of R, 0.8 mass % to 1.2 mass % of B, inevitably contained impurity elements, and TM as the balance.

In another preferred embodiment, the permanent magnets include a first magnet and a second magnet, which face each other with the magnetic field generating space interposed, and the first and second magnets are arranged along a line that passes a center portion of the magnetic field generating space and that is parallel to a magnetic field direction in the center portion.

In another preferred embodiment, a magnet assembly made up of the permanent magnets is substantially symmetric with respect to a first plane including the line, but is asymmetric with respect to a second plane that includes the line but that crosses the first plane at right angles.

In another preferred embodiment, at least a portion of the outer periphery of the magnet assembly is covered with a ferromagnetic material.

In another preferred embodiment, the permanent magnets further include a third magnet and a fourth magnet, which are arranged so as to sandwich the first magnet between them, and a fifth magnet and a sixth magnet, which are arranged so as to sandwich the second magnet between them. The size of the third magnet as measured perpendicularly to the second plane is smaller than that of the fourth magnet as also measured perpendicularly to the second plane. The size of the fifth magnet as measured perpendicularly to the second plane is smaller than that of the sixth magnet as also measured perpendicularly to the second plane.

In another preferred embodiment, the magnetic field generator further includes additional magnets for changing the strength of the magnetic field to be generated in the magnetic field generating space. The additional magnets form a moving magnetic circuit portion, which couples magnetically to at least some of the permanent magnets, and are supported such that their positions relative to the magnetic field generating space are changeable.

In another preferred embodiment, the moving magnetic circuit portion includes a plurality of magnets as its members, and the magnets are movable horizontally.

In another preferred embodiment, the permanent magnets further include a seventh magnet, which is located between the fourth and sixth magnets.

In another preferred embodiment, the magnetic field generator further includes a mechanism for keeping the temperature of the permanent magnets lower than room temperature.

In another preferred embodiment, a ferromagnetic body, which changes its thickness according to a distance from the second plane, is provided on each of opposed surfaces of the first and second magnets.

In another preferred embodiment, each of the permanent magnets has a rectangular parallelepiped shape.

A particle accelerator according to the present invention includes one of the magnetic field generators described above, and a shielding plate with a thickness of at least 0.1 mm, which is provided between the magnetic field generator and a source of a radiation.

DETAILED DESCRIPTION OF PREFERRED EMBODIMENTS

Hereinafter, preferred embodiments of the present invention will be described with reference to the accompanying drawings.

Figure 2:
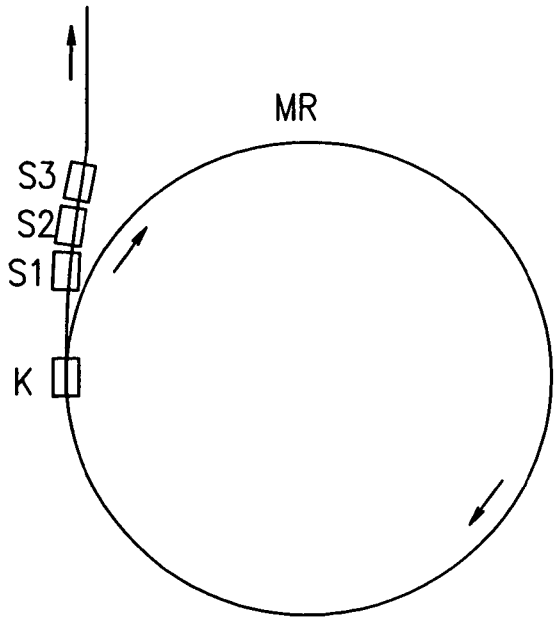
FIG. 2 schematically shows a configuration for a particle accelerator in which permanent magnets of the present invention can be used effectively.

FIG. 2 schematically shows a configuration for a particle accelerator in which permanent magnets of the present invention can be used effectively.

The particle accelerator shown in FIG. 2 at least includes a main ring MR for accelerating a particle beam, a kicker magnet K for applying a pulse magnetic field to the particle beam traveling along the main ring, and septum magnets S1, S2 and S3 for further bending the particle beam that has been deviated by the kicker magnet K off the orbit in the main ring.

The main ring MR and the kicker magnet K have the same configurations as the conventional one. And this preferred embodiment is characterized by the arrangement of the septum magnets. Thus, the following description will be focused on the details of those septum magnets.

Figure 3:
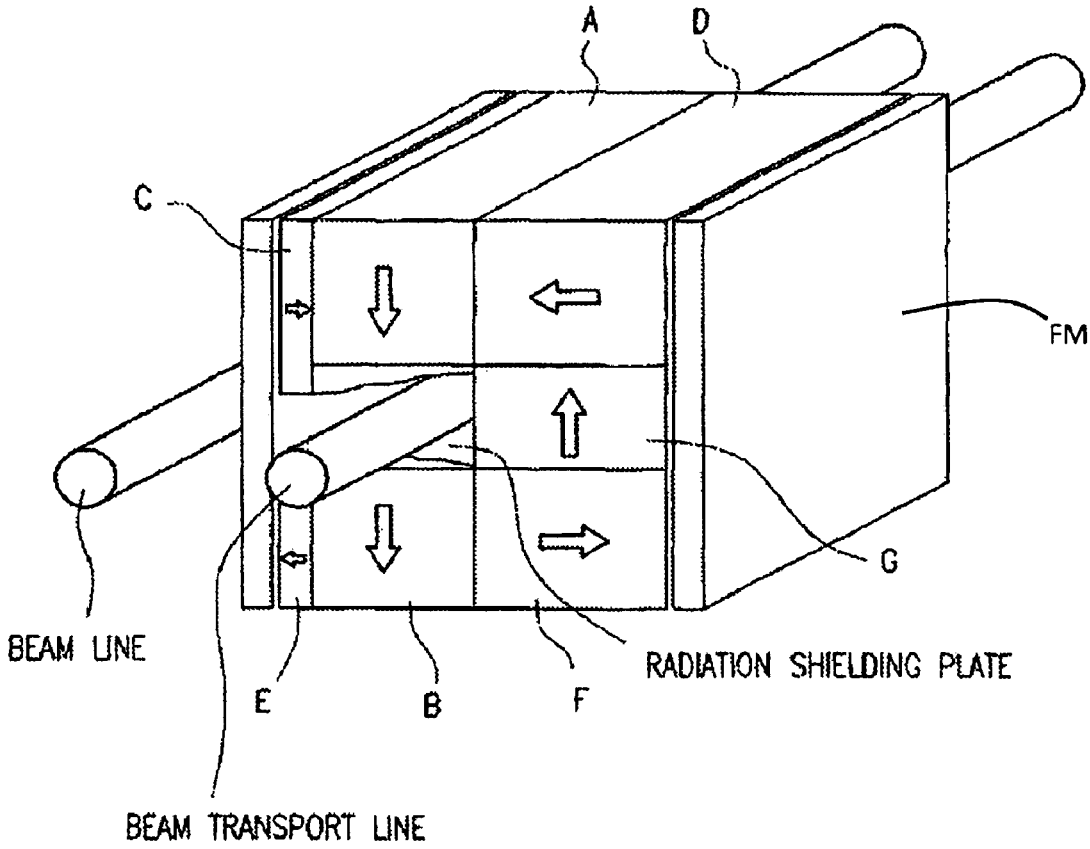
FIG. 3 is a schematic perspective view showing the structure of a septum magnet made up of permanent magnets.

Referring to FIG. 3, illustrated is a magnetic field generator according to this preferred embodiment for use in at least one (and preferably all) of the septum magnets S1, S2 and S3. In FIG. 3, X, Y and Z coordinate axes are shown. The origin of this coordinate system is supposed to be located at the center of a magnetic field generating space in which a beam transport line passes. Specifically, the Z-axis direction is parallel to the direction of a magnetic field to be affected by a particle flying through the beam transport line. The Y-axis direction is parallel to the direction in which the particle is flying in the beam transport line. If the particle flying through the beam transport line is a proton, then the X-axis direction is parallel to the direction in which force is applied to that proton. It should be noted that if the particle were a negatively charged particle such as an electron, then the direction in which force is applied to that particle would be antiparallel to the X-axis direction unless the configuration of the magnetic field generator shown in FIG. 3 were changed. This magnetic field generator needs to apply force to the particle in such a direction as to make the particle more distant from the beam line. Accordingly, if the particle is negatively charged, then the magnetization direction of each permanent magnet needs to be inverted such that the direction of the magnetic field to be generated in the magnetic field generating space matches -Z-axis direction.

The magnetic field generator of this preferred embodiment is provided near the beam line in the main ring and applies a strong bending magnetic field to the beam transport line, which is separated from the beam line. Thus, a number of permanent magnets are arranged substantially in a ring so as to surround the beam transport line.

Each of the permanent magnets that form this magnetic field generator is an Nd—Fe—B based sintered magnet, which includes R (which is at least one of the rare-earth elements), B (boron), TM (which is at least one transition element and includes Fe) and inevitably contained impurity elements. In a preferred embodiment, the magnet includes 25.0 mass % to 40.0 mass % of R, 0.8 mass % to 1.2 mass % of B, inevitably contained impurity elements, and TM as the balance. Also, the magnet of this preferred embodiment has been magnetized to a permeance coefficient of 0.5 or more and has a coercivity $H_{cJ}$ of 1.6 MA/m or more. The composition and magnetic properties of this permanent magnet will be described more fully later. Before that, a magnetic circuit consisting of these permanent magnets will be described first.

Furthermore, if a magnet circuit, made up of those permanent magnets, were exposed to an elevated temperature, then the degree of uniformity of the magnetic field might decrease. To minimize such a decrease in the degree of uniformity of the magnetic field, those permanent magnets are preferably subjected to an aging treatment (e.g., heated to a temperature of 40° C. to 70° C.) as disclosed in Japanese Patent Application Laid-Open Publication No. 2003-305021.

The magnetic field generator of this preferred embodiment consists of seven permanent magnet regions, each having a rectangular parallelepiped shape. By arranging these permanent magnets substantially in a ring around the magnetic field generating space, a magnetic circuit, similar to a Halbach type magnetic field circuit, is formed. Among the respective permanent magnets that form the magnetic circuit shown in FIG. 3, first and second magnet regions A and B face each other with the magnetic field generating space interposed between them and are arranged along a line that passes the center of the magnetic field generating space (i.e., the Z-axis).

Third and fourth magnet regions C and D are arranged on both sides of the first magnet region A so as to sandwich the first magnet region A between them. Likewise, fifth and sixth magnet regions E and F are arranged on both sides of the second magnet region B so as to sandwich the second magnet region B between them. Furthermore, a seventh magnet region G is provided between the fourth and sixth magnet regions D and F.

The magnetization direction of the first and second magnet regions A and B matches the direction of the magnetic field to be generated at the center of the magnetic field generating space, and points the Z-axis direction. On the other hand, the magnetization direction of the third and sixth magnet regions C and F points the X-axis direction, while that of the fourth and fifth magnet regions D and E points the -X-axis direction. And the magnetization direction of the seventh magnet region G points the -Z-axis direction, which is antiparallel to that of the first and second magnet regions A and B.

In this manner, these seven permanent magnet regions A through G are arranged substantially in a ring so as to define the magnetic field generating space at their center. However, these magnets do not form a completely ringlike structure but leave a no permanent magnet space between the beam line and the beam transport line. Thus, the magnet assembly (or magnetic circuit) shown in FIG. 3 is not a "Halbach type" strictly speaking, but has a "C (or U)" arrangement with a gap.

Suppose a first virtual plane including the line (i.e., the Z-axis) that passes the center of the magnetic field generating space (i.e., an XZ plane) and a second virtual plane including that Z-axis and crossing the first plane at right angles (i.e., a YZ plane). In that case, the magnet assembly (i.e., magnetic circuit) consisting of the seven permanent magnet regions A through G is substantially symmetric with respect to the first plane (XZ plane) but is asymmetric with respect to the second plane (YZ plane). That is to say, this magnet assembly is designed such that the size of the third and fifth magnet regions C and E as measured perpendicularly to the YZ plane (i.e., in the X-axis direction; and the size will be referred to herein as a "X-direction size") is smaller than the X-direction size of the fourth and sixth magnet regions D and F.

A magnetic circuit with such a horizontally asymmetric structure is adopted for the purpose of generating a strong magnetic field even if there is just a narrow gap between the beam line and the beam transport line. The septum magnet S1 shown in FIG. 2 is located closer to the main ring MR than any other septum magnet. However, if a conventional Halbach type magnetic circuit arrangement were adopted, then it would be difficult to put the magnet at such a position. Meanwhile, in the arrangement of this preferred embodiment, a magnetic field generator with the configuration shown in FIG. 3 can be used for the septum magnet S1. Optionally, each magnet region may be a stack of smaller magnets. Further, at least a portion of the outer periphery of the magnet assembly can be covered with a ferromagnetic material FM.

Figure 4:
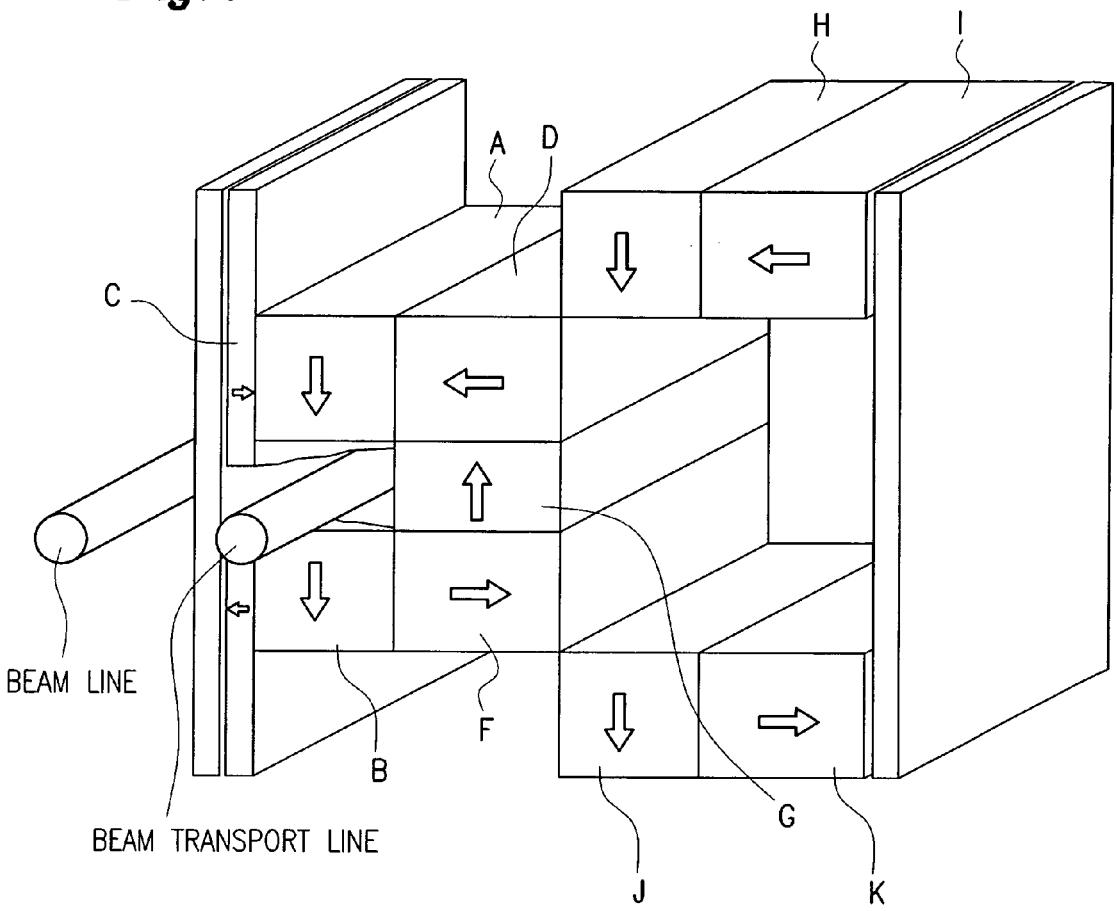
FIG. 4 is a perspective view showing a modified example of the configuration shown in FIG. 3.

In order to change the field strength in the magnetic field generating space, additional permanent magnets may be further provided so as to form a moving magnetic circuit portion as shown in FIG. 4. The moving magnetic circuit portion shown in FIG. 4 includes an eighth magnet region H, a ninth magnet region I, a tenth magnet region J and an eleventh magnet region K. The eighth and ninth magnet regions H and I are magnetized in the same directions as the first and fourth magnet regions A and D, respectively. On the other hand, the tenth and eleventh magnet regions J and K are magnetized in the same directions as the second and sixth magnet regions B and F, respectively.

The eighth, ninth, tenth and eleventh magnet regions H, I, J and K are supported so as to be movable horizontally. If these magnets are gradually moved to the left in FIG. 4, the eighth and ninth magnet regions H and I will eventually be located just over the first and fourth magnet regions A and D, respectively, while the tenth and eleventh magnet regions J and K will eventually be located right under the second and sixth magnet regions B and F, respectively. In that situation, the magnetic field generator shown in FIG. 4 will have an arrangement as if the first and fourth magnet regions A and D and the second and sixth magnet regions B and F of the magnetic field generator shown in FIG. 3 were split into two vertically.

By moving the eighth, ninth, tenth and eleventh magnet regions H, I, J and K horizontally and adjusting the positions thereof, the strength of the magnetic field to be generated in the magnetic field generating space can be controlled arbitrarily within a predetermined range and without significantly disturbing the magnetic field distribution.

Also, although not shown in FIG. 4, to reduce the leaking magnetic field or facilitate the assembly, a member made of a material with a high saturation flux density (e.g., iron, an iron-nickel alloy or an iron-cobalt alloy) may be provided around the outer periphery of the magnets H, I, J and K.

It should be noted that the arrangement and number of magnet regions to make such a moving magnetic field circuit portion are not limited to those shown in FIG. 4.

As a mechanism for moving these magnets H, I, J and K, a known linear guide, screw or bearing motor may be used, for example. Also, these magnets may be positioned with a known sensor or magnetic scale.

At a branching point between the beam line and the beam transport line, a member is radioactivated particularly easily due to exposure to a particle beam. Thus, the radioactivated member may irradiate the septum magnets with a particle beam, which is a problem. In this preferred embodiment, sintered magnets, which are hardly demagnetized even when exposed to a radiation, are adopted as will be described later. Even so, the radiation dose of the particle beam is preferably reduced as much as possible. For that purpose, a radiation shielding plate is preferably provided between the surface of the magnets and the source of the radiation because the exposure dose of the magnets can be reduced then. If the shielding plate had a thickness of less than 0.1 mm, then the shielding plate could not reduce the exposure dose so effectively. That is why the shielding plate preferably has a thickness of at least 0.1 mm. As the material of the shielding plate, $^{10}B$, which is a boron isotope having a great scattering cross section with respect to a thermal neutron, or a boron stainless steel material, including a lot of normal boron, is preferred.

Figure 1:
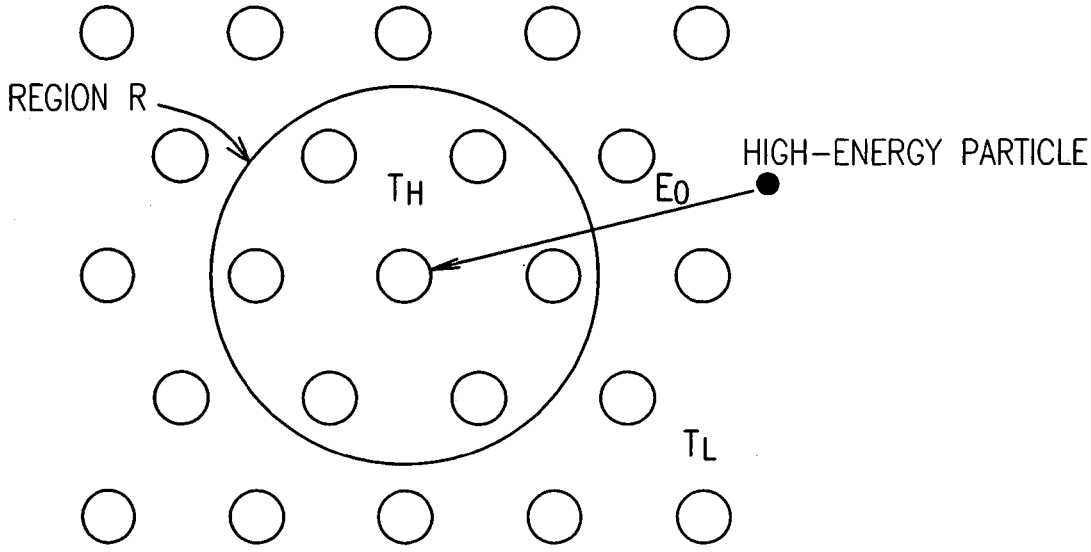
FIG. 1 is a schematic representation showing the crystal structure of a magnet exposed to a radiation, in which the open circles represent some atoms that form the magnet.

Also, the temperature of the magnets is preferably kept lower than room temperature. If a mechanism for cooling the magnets is provided, then the coercivity will increase as compared with a situation where the magnet temperature is substantially equal to room temperature. Plus, the increased temperature $T_H$ of the region R shown in FIG. 1 will decrease, too, thereby reducing the demagnetization effectively at the time of exposure.

As a means for cooling the magnets, a freezing mixture such as liquid nitrogen, liquid helium or solid carbon dioxide or a refrigerator that uses a circulating refrigerant or a Peltier device may be adopted. In cooling the magnets, R preferably includes Pr instead of Nd. This is because the decrease in remanence, which is observed in an Nd-based magnet due to a spin rearrangement phenomenon at a low temperature, can be minimized. Also, to prevent the magnet material from being radioactivated, TM preferably includes no Co. For an R-TM-B based magnet, Co is not an essential element. Thus, a magnet composition including no Co is realized very easily.

A magnet according to the present invention has a composition including 25.0 mass % to 40.0 mass % of R (which is at least one of the rare-earth elements) , 0.8 mass % to 1.2 mass % of B (boron) , and TM (which is at least one transition element and includes Fe) as the balance. However, the magnet may further include inevitably contained impurity elements. If R were less than 25.0 mass %, then the coercivity would decrease. However, if R exceeded 40.0 mass %, then the remanence would decrease. A preferred R range is 29.0 mass % through 32.0 mass %. R preferably further includes Dy and/or Tb as well as Nd because the intrinsic coercivity will increase then. Dy and/or Tb preferably accounts for at least 2.5 mass % of the overall magnet composition. If B (boron) were less than 0.8 mass %, then the coercivity would decrease. However, if B exceeded 1.2 mass %, then the remanence would decrease. Unless TM included Fe, the remanence would decrease. For that reason, TM always includes Fe. Preferably, Fe accounts for at least 50 mass % of the overall TM.

An R-TM-B based sintered magnet according to this preferred embodiment may be produced by performing the process steps of pulverizing a material alloy, compacting the powder under a magnetic field, sintering the compact within a vacuum, thermally treating the sintered compact, machining the magnet and then coating the surface thereof, for example. An R-TM-B based sintered magnet produced in this manner preferably has a density of at least 7.5 g/cm$^3$ and a crystal grain size of 1 μm to 20 μm, more preferably 5 μm to 10 μm.

The R-TM-B based sintered magnet of this preferred embodiment has been magnetized to a permeance coefficient of at least 0.5. And the composition thereof is controlled such that the decrease in its surface flux density is less than 5% when the magnet is exposed to a radiation at an absorbed dose of at least 3,000 Gy. If the surface flux density decreased by 5% or more, then the resultant magnetic circuit would lack in stability. Also, a magnet, having such a shape as to result in a permeance coefficient of less than 0.5, generates a significant anti-magnetic field in itself. Thus, even if the magnet is exposed to the radiation under the same conditions, the surface flux density tends to decrease by a greater percentage. For that reason, the permeance coefficient is defined at least equal to 0.5 according to the present invention.

As used herein, the "absorbed dose" of a magnet refers to the total quantity of radiation that has been absorbed into the magnet, no matter whether the exposure duration is short or long. That is to say, the absorbed dose of 3,000 Gy means the radiation dose in a situation where the magnet has absorbed a radiation energy of 3,000 J per kG.

If a 1 kG magnet has absorbed a radiation energy of 3,000 J and if that energy is all transformed into heat, the temperature increase of the magnet is estimated to be 6 K when the magnet has a specific heat of 0.5 $JK^{-1}$ g−1. The temperature increase of 6K is not so big as to cause serious thermal demagnetization. In a conventional magnet, however, the magnetization does invert, and the surface flux density does decrease, even if the temperature has increased just locally as described above.

EXAMPLES

Example 1

First, an R-TM-B based material powder, having a composition including Nd, Dy, B, Fe and inevitably contained impurity elements as shown in the following Table 1, was prepared. The powder had a mean particle size of 3.0 μm. This powder was compacted under a magnetic field and then sintered at 1,060° C. for 4 hours within a vacuum, thereby obtaining a sintered magnet material. A sample piece was taken from the sintered magnet material, magnetized and then its magnetic properties were measured at room temperature. The results are shown in the following Table 2, which additionally shows the Curie temperature (Tc) of each sintered magnet material.

TABLE 1

| | | Magnet composition (mass %) | | | |
|---|---|---|---|---|---|
| | No. | Nd | Dy | B | Fe |
| Examples | 1 | 21.0 | 10.0 | 1.0 | Balance |
| | 2 | 23.5 | 7.5 | 1.0 | Balance |
| | 3 | 26.0 | 5.0 | 1.0 | Balance |
| Comparative | 4 | 28.5 | 2.5 | 1.0 | Balance |
| Examples | 5 | 31.0 | — | 1.0 | Balance |

TABLE 2

| | No. | $B_r$ (T) | $H_{cJ}$ (MA/m) | $(BH)_{max}$ (kJ/m$^3$) | Curie temperature (° C.) |
|---|---|---|---|---|---|
| Examples | 1 | 1.15 | 2.4 | 255 | 316 |
| | 2 | 1.21 | 2.0 | 279 | 316 |
| | 3 | 1.26 | 1.6 | 303 | 316 |
| Comparative | 4 | 1.33 | 1.3 | 342 | 318 |
| Examples | 5 | 1.39 | 0.9 | 374 | 316 |

Next, the resultant sintered magnet material was machined to obtain rectangular parallelepiped magnet workpieces in which the magnetization direction was 10 mm and the magnetization hard direction was 34 mm square. Then, those magnet workpieces were magnetized two by two according to each of the compositions shown in Table 1.

Thereafter, a pole piece was attracted toward the N pole of one of two magnet workpieces having the same composition and another pole piece was attracted toward the S pole of the other magnet. Each of these pole pieces was made of an iron plate with a thickness of 1 mm and a length of 34 mm square. Furthermore, these pole pieces were attracted toward each other with a spacer sandwiched between them, thereby completing a pair of magnet samples. The spacer was made of an acrylic plate with a thickness of 1.65 mm and a length of 34 mm square, and an opening with a width of 5 mm was provided at the center of the spacer so as to insert the Hall device of the gauss meter through the opening and measure the flux density at the center of the gap portion. The average permeance coefficient Pc ($B/\mu_0 H$) of the magnet samples prepared in this manner was 1.2.

These magnet samples were provided by a septum electromagnet, which was located at the beam outlet port of the main ring of a proton synchrotron accelerator. The distance between the magnet samples and the beam line was defined at 85 cm.

Next, the magnet samples were exposed to neutrons, which were produced when accelerated protons collided against the tube of the beam line. The absorbed dose of the magnet samples was measured as to what degree an aluminum sample, arranged by the magnet samples, was radioactivated. When the absorbed dose of the magnet samples reached 3,500 Gy, the center magnetic flux of the magnet samples was measured. The decrease in surface magnetic flux before and after the samples were exposed is shown in the following Table 3.

TABLE 3

| | No. | Decrease (%) in center magnetic flux Pc = 1.2 |
|---|---|---|
| Examples | 1 | 1.0 |
| | 2 | 3.3 |
| | 3 | 5.0 |
| Comparative | 4 | 8.3 |
| Examples | 5 | 38.7 |

Comparative Example 1

Sintered magnets having the compositions shown in Table 1 were produced under quite the same manufacturing conditions as those of Example No. 1, thereby obtaining sintered magnet materials having the magnetic properties shown in Table 2. The magnet materials thus obtained were subjected to the same machining process and exposure test as those of Example No. 1. Table 3 shows the decreases in the center magnetic flux of magnet samples (representing these comparative examples) when the absorbed dose thereof reached 3,500 Gy.

As can be seen from Table 3, as to Examples Nos. 1 to 3, even when the magnets were exposed to the radiation until the absorbed dose reached 3,500 Gy, the decreases in surface magnetic flux could be no greater than 5%, which is a negligible level in practice. In Comparative Examples Nos. 1 and 2 on the other hand, the decreases in surface magnetic flux exceeded 5%.

As can be seen from Table 2, there is almost no difference in Curie temperature between the specific examples and the comparative examples. According to the model that has already been described with reference to FIG. 1, if the Curie temperatures were almost the same, then the demagnetization due to the exposure to a radiation should advance to approximately the same degree irrespective of the magnitude of the coercivity. Actually, however, the higher the coercivity, the smaller the percentage of demagnetization, which was an unexpected result.

Example 2

First, an R-TM-B based material powder, having a composition including Nd, Dy, B, Fe and inevitably contained impurity elements and having a mean particle size of 3.0 μm, was prepared. This powder was compacted under a magnetic field and then sintered at 1,060° C. for 4 hours within a vacuum, thereby obtaining a sintered magnet material having a composition including 28.5 mass % of Nd, 2.5 mass % of Dy, 1.0 mass % of B, 1.0 mass % of Co, and Fe as the balance. A sample piece was taken from each of these sintered magnet materials, magnetized and then its magnetic properties were measured at room temperature. The resultant magnetic properties included a $B_r$ of 1.33 T, an $H_{cJ}$ of 1.3 MA/m and a $(BH)_{max}$ of 342 kJ/m$^3$.

Next, the resultant sintered magnet material was machined to obtain rectangular parallelepiped magnets. Then, those magnets were magnetized. A magnetic field generator having the configuration shown in FIG. 3 was assembled of the magnetized rectangular parallelepiped magnets. It should be noted that it was difficult to make each of the magnet regions shown in FIG. 3 of a single magnet material. For that reason, the magnetic field generator shown in FIG. 3 was fabricated by adhering a large number of small magnet material blocks together.

In such a magnetic field generator, a magnetic field of 1.10 T was generated between two opposed iron shims. In this specific example, each of these iron shims has a sloped portion on its opposing side. By providing these opposed portions, the gap between the opposed iron shims changes along the X-axis shown in FIG. 3. If the shape of the iron shims is designed appropriately, then the degree of uniformity of the magnetic field generated can be increased. The degree of uniformity of the magnetic field strength along the X-axis shown in FIG. 3 was within ±3% in a magnetic field generating space that was located approximately at the center of the generator. Also, on the left-hand side of the magnetic field generator shown in FIG. 3, the leaking magnetic field was 1.4 mT.

In actually incorporating the magnetic field generator thus obtained as a septum magnet into a particle accelerator, the magnetic field generator may be designed such that a stainless steel tube of a beam transport line, branched from a kicker magnet, is inserted into the center of the magnetic field generating space as shown in FIG. 3 and that the stainless steel tube of the beam line of the main ring passes outside of the iron magnetic shield plate shown on the left hand side of FIG. 3. In that case, the accelerated particles can be bent with a strong magnetic field of 1.0 T or more in the stainless steel tube of the beam transport line.

In this specific example, since just a small magnetic field leaks into the stainless steel tube of the beam line of the main ring, there is no concern about undesired bending. Also, the magnet has a small Co content. Thus, it is expected that a smaller quantity of radiation would be generated from the magnetic field generator due to radioactivation as compared with a magnetic field generator using Sm—Co based sintered magnets. As a result, the exposure dose of workers can be reduced during the maintenance of the magnetic field generator.

As can be seen from the results of Example No. 1, if a magnetic field generator according to Example No. 2 is assembled of the magnets of the present invention with $H_{cJ}$ of 1.6 MA/m or more, the magnets that form the magnetic field generator demagnetize just slightly even when exposed to the neutrons produced during the operation of the accelerator.

As can be seen, a septum magnet of an Nd—Fe—B permanent magnet type, which can generate a stabilized static magnetic field with a high degree of uniformity without consuming electricity or circulating cooling water, which hardly decreases its magnetic field generated even when exposed to the radiation produced during the operation of the accelerator, and which has, similar functions to those of a conventional electromagnet type septum magnet, can be provided in this manner.

The present invention provides a permanent magnet for a particle accelerator and a magnetic field generator, which uses an Nd—Fe—B based magnet but does not demagnetize easily even when exposed to a radiation. According to the present invention, a strong magnetic field required for a particle accelerator can be generated without consuming a lot of electricity unlike an electromagnet.

The invention claimed is:

1. A magnetic field generator to be used in an environment in which the magnetic field generator is exposed to a radiation at an absorbed dose of at least 3,000 Gy, the magnetic field generator comprising:

a plurality of permanent magnets that are arranged substantially in a C or U shape so as to define a magnetic field generating space; and additional magnets for changing the strength of the magnetic field to be generated in the magnetic field generating space; wherein each of the plurality of permanent magnets includes R (which is at least one of the rare-earth elements), B (boron), TM (which is at least one transition element and includes Fe), and inevitably contained impurity elements and is a sintered magnet having a composition of:

25.0 mass % to 40.0 mass % of R;

0.8 mass % to 1.2 mass % of B;

inevitably contained impurity elements; and

TM as the balance;

each of the plurality of permanent magnets have been magnetized to a permeance coefficient of 0.5 or more and has a coercivity $H_{cj}$ of 1.6 MA/m or more;

the plurality of permanent magnets include:

a first magnet and a second magnet, which face each other with the magnetic field generating space interposed;

a third magnet and a fourth magnet, which are arranged so as to sandwich the first magnet between them; and a fifth magnet and a sixth magnet, which are arranged so as to sandwich the second magnet between them;

the first and second magnets are arranged along a line that passes a center portion of the magnetic field generating space and that is parallel to a magnetic field direction in the center portion;

the size of the third magnet as measured perpendicularly to the second plane is smaller than that of the fourth magnet as also measured perpendicularly to the second plane;

the size of the fifth magnet as measured perpendicularly to the second plane is smaller than that of the sixth magnet as also measured perpendicularly to the second plane;

a magnet assembly made up of the permanent magnets is substantially symmetric with respect to a first plane including the line, but is asymmetric with respect to a second plane that includes the line but that crosses the first plane at right angles;

at least a portion of the outer periphery of the magnet assembly is covered with a ferromagnetic material; and the additional magnets form a moving magnetic circuit portion, which couples magnetically to at least some of the permanent magnets, and are supported such that their positions relative to the magnetic field generating space are changeable.

2. The magnetic field generator of claim 1, wherein the moving magnetic circuit portion includes a plurality of magnets as its members, the magnets being movable horizontally.

3. The magnetic field generator of claim 1, wherein the permanent magnets further include a seventh magnet, which is located between the fourth and sixth magnets.

4. The magnetic field generator of claim 1, further comprising a mechanism for keeping the temperature of the permanent magnets lower than room temperature.

5. The magnetic field generator of claim 1, wherein a ferromagnetic body, which changes its thickness according to a distance from the second plane, is provided on each of opposed surfaces of the first and second magnets.

6. The magnetic field generator of claim 1, wherein each of the permanent magnets has a rectangular parallelepiped shape.

7. A particle accelerator comprising the magnetic field generator of claim 1, and a shielding plate with a thickness of at least 0.1 mm, which is provided between the magnetic field generator and a source of a radiation.

* * * * *

UNITED STATES PATENT AND TRADEMARK OFFICE

CERTIFICATE OF CORRECTION

PATENT NO. : 7,570,142 B2
APPLICATION NO. : 10/524314
DATED : August 4, 2009
INVENTOR(S) : Ken Makita et al.

It is certified that error appears in the above-identified patent and that said Letters Patent is hereby corrected as shown below:

On the title page, item (73): Assignee on the front page of the patent, list the following two companies as the Assignees:

Hitachi Metals, Ltd., Tokyo (JP)

Inter-University Research Institute Corporation High Energy Accelerator Research Organization, Tsukuba-shi (JP)

Signed and Sealed this

Thirteenth Day of October, 2009

David J. Kappos

David J. Kappos
*Director of the United States Patent and Trademark Office*